United States Patent [19]

Gröger et al.

[11] 4,445,724

[45] May 1, 1984

[54] CUTTER-LOADER APPARATUS HAVING OVERHUNG SHEARER DRUM

[75] Inventors: Hans Gröger, Essen-Stelle-Horst; Ernst E. Harms, Hattingen, both of Fed. Rep. of Germany

[73] Assignee: Gebr. Eickhoff Maschinenfabrik und Eisengiesserei mbH, Bochum, Fed. Rep. of Germany

[21] Appl. No.: 305,442

[22] Filed: Sep. 25, 1981

[30] Foreign Application Priority Data

Oct. 1, 1980 [DE] Fed. Rep. of Germany ..... 3036981

[51] Int. Cl.[3] ..... E21C 25/60

[52] U.S. Cl. ..... 299/81; 299/90; 299/44

[58] Field of Search ..... 299/17, 34, 43, 45, 299/46, 53, 54, 81, 87, 89, 90

[56] References Cited

U.S. PATENT DOCUMENTS

| | | | |
|---|---|---|---|
| 1,530,768 | 3/1925 | Haag | 299/81 |
| 1,700,294 | 1/1929 | Levin | 299/53 |
| 3,563,324 | 2/1971 | Lauber | 299/81 |
| 3,957,305 | 5/1976 | Peterson | 299/18 |
| 4,049,318 | 9/1977 | Fruin | 299/17 |
| 4,243,268 | 1/1981 | Löbbe et al. | 299/17 |

FOREIGN PATENT DOCUMENTS

| | | | |
|---|---|---|---|
| 2631585 | 1/1978 | Fed. Rep. of Germany | 299/81 |

*Primary Examiner*—Stephen J. Novosad
*Assistant Examiner*—William P. Neuder
*Attorney, Agent, or Firm*—Thomas H. Murray

[57] ABSTRACT

A long wall mining machine includes a drum cutter-loader and face conveyor wherein the drum cutter-loader is overhung and is supported by a support arm adjacent to the mine face. Nozzles direct high pressure liquid jets against the forward edge of the support arm to cut away the mining face and permit the face side support arm to advance as the mining machine advances. In one embodiment the nozzles are provided along an inclined cutting edge at the forward end of the support arm. Such nozzles may be fixed or oscillating. In an alternative embodiment the nozzles are provided in the cylindrical edge zone of the shearer drum and direct the high pressure fluid jets against the cutter edge at the forward end of the support arm.

4 Claims, 2 Drawing Figures

CUTTER-LOADER APPARATUS HAVING OVERHUNG SHEARER DRUM

BACKGROUND OF THE INVENTION

Field of the Invention: This invention relates to a cutter-loader apparatus in combination with a face conveyor commonly referred to as long wall mining apparatus. More particularly, this invention relates to such cutter-loader apparatus having an overhung shearer drum which rotates about an axis parallel to the mine floor, wherein the shearer drum is mounted on a support arm and is provided with helical whorls over the drum's cylindrical surface for laterally removing loosened spoil from the mining area to a subjacent face conveyor.

Description of the Prior Art: Drum cutter-loaders are known. German patent specification No. 21 13 399. Such devices are employed principally for working thin mining seams. The body of such apparatus is positioned close to a face conveyor and rests directly on the floor of the mine, at least in the deepest part of the mining cut. The overhung shearer drums release the mineral and remove the spoil by means of helical whorls over the cylindrical surface of the rotating shearer drum. Customarily two shearer drums are employed, each supported by a support arm which is substantially parallel to the mine floor and which is positioned adjacent to the face conveyor on the face side of the shearer drum and above the machine track. Such support arms accommodate the transmission elements which transmit the motor drive to the shearer drums and accordingly have appropriate vertical dimensions which interfere with the removal of spoil by the shearer drum, particularly when the spoil is in the form of large lumps. Such overhung shearer drums have relatively large dimensions and hence must cut the entire machine body free, requiring relatively high driving power. The shearer drum mountings are supported at one end and accordingly are sufficiently strong to accommodate appreciable cutting and shearing stresses which occur during the mining operations.

If the support arm for such apparatus were disposed in the deepest part of the mining cut, that is, on the face side of the machine body wall, spoil removal might be improved but the support arm would have to be cut free over its entire width, for example, by means of a rotating cutter chain in advance of the support arm. Such a cutter chain would require tensioning devices to maintain proper chain tension. Such devices would preclude providing a transmission inside the support arm to transmit to the shearer drum the appreciable drive power from the drive motor which is located inside the machine body. In such a machine, the rotary motion of the drive motor could be transmitted to the shearer drum by means of the cutter chain rotating support arm. Since a single cutter chain is not sufficient to transmit the required drive power for the shearer drum, appreciable power losses would be tolerated; such a drum cutter-loader could not be employed in a cost-effective manner.

In German patent specification No. 11 96 146, long wall mining machines with overhung shearer drums are disclosed. The shearer drums are supported by two lateral arms at different heights. The support arm on the face side which is situated within the seam is equipped with a cutter chain. The support arm outside the seam is provided as low as possible in order to avoid obstructing the removal of spoil material. The outside support arm transmits the power between the mining machine drive motor and the shearer drum. To accomplish this, a variable length drive shaft extends over the length of the support arm for transmitting the drive motion from the motor within the machine body to the shearer drum. The same drive shaft also, through the drum, engages the rotating cutter chain which cuts free the face side support arm.

DESCRIPTION OF THE INVENTION

The principal object of this invention is to improve the removal of spoil material from a shearer drum in a drum cutter-loader having an overhung shearer drum.

According to this invention, such drum cutter-loader is provided with support arms on the face side of the machine body in the seam area. High pressure liquid jets, usually water jets, are provided to cut free the support arm. With the present invention, the entire height of the seam is available to receive the spoil during its removal so that even large lumps of spoil material will enter the face conveyor without obstruction.

In one embodiment the support arm end which is adjacent to the shearer drum is provided with nozzles, particularly in the end face of such support arm. The nozzles are directed substantially in the direction of the travel of the machine so that high pressure liquid jets will be directed against the face to accommodate the support arm. The support arm end is positioned forwardly beyond the diameter of the shearer drum body and is provided with an inclined surface over the entire height of the support arm. The inclined surface constitutes a cutting edge which is positioned in the deepest part of the cut and points in the direction of machine travel. Some oscillating nozzles may be provided to direct high pressure liquid jets against the face to release a strip of mineral corresponding to the cross-section of the support arm. The spoil or mineral rib outcrop created by the high pressure liquid jets is removed by means of the cutting edge and is laterally displaced over the inclined surface until it is brought into the range of action of the helical whorls of the shearer drum.

Further, some of the nozzles may be inclined so that the high pressure liquid jets are directed in the planes of the contour of the support arm. In this instance, the high pressure liquid jets will release a strip of the seam corresponding to the cross-section of the support arm.

In an alternative embodiment, the edge zone of the cylindrical surface of the shearer drum body which is adjacent to the face end of the shearer drum may be provided with nozzles extending radially outwardly from the shearer drum surface. High pressure liquid is introduced during the shearer drum rotation into those nozzles which are in that portion of the peripheral area of the shearer drum edge face which is not opposite the support arm. That is, the high pressure liquid jets from the nozzles are activated over the entire height of the support arm during the rotation of the shearer drum. In this embodiment the support arm has a seam area which avoids obstruction of the movement of the machine. The cutting edge of the support arm and the inclined surface transfer the mineral which has been loosened by the high pressure jets toward the whorls of the shearer drum.

In order that the high pressure water jets can reach the seam face unobstructed by the support arm, in another embodiment of this invention, the cutting edge of the support arm extends centrally of the axis of the shearer drum. The high pressure water jets are parallel to the inclined surface of the support arm and rotate on a locus which is concentric with the axis of the shearer drum. Accordingly, the high pressure liquid jets do not impinge on the support arm.

DESCRIPTION OF THE PREFERRED EMBODIMENTS

Figure 1:
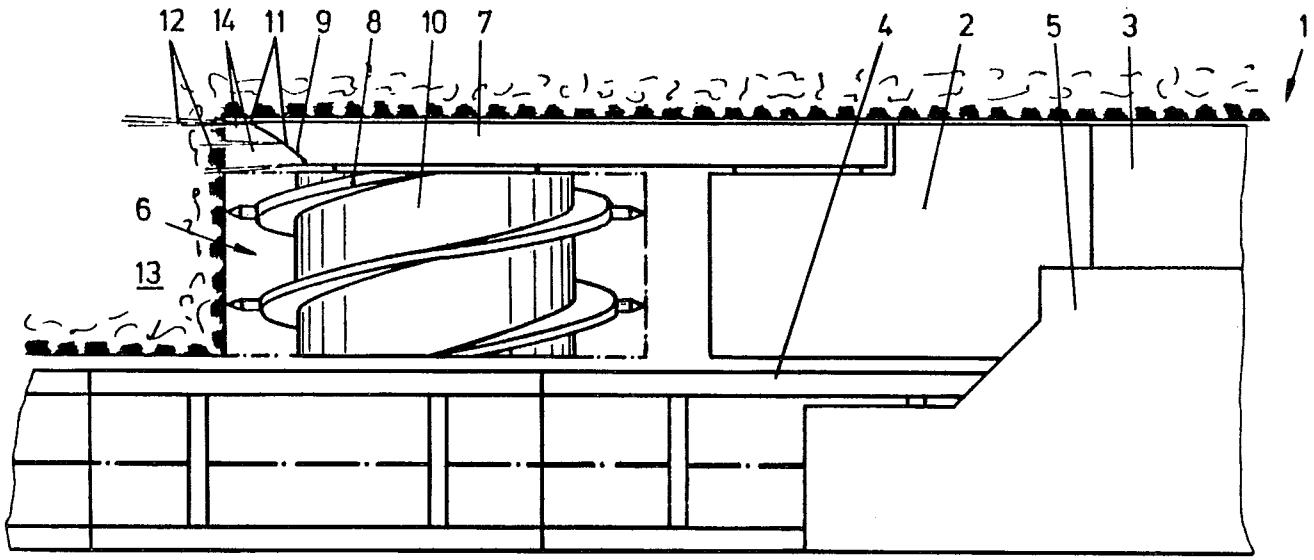
FIG. 1 is a plan view of a drum cutter-loader and face conveyor mining apparatus.

A drum cutter-loader is identified by the numeral 1. Units 2, 3 include a drive motor source, controls, hydraulic pumps and controls, for example. The apparatus includes a face conveyor 4 and a bridge 5 which covers the face conveyor 4 by means of movable supports (not shown). An overhung shearer drum 6 on the cutter-loader device rotates about an axis parallel to the floor of the mine. Each shearer drum 6 is mounted on a support arm 7 having adjusting means (not shown) for vertical adjustment on the body of the cutter-loader 1 on the face side. The rotation of the shearer drums 6 loosens the mineral and the spoil is transferred by helical whorls 8 which feed the spoil material laterally from the mining area onto the conveyor 4. The end face of the support arm 7 has a vertically extending cutting edge 9 which is disposed in the deepest part of the cut. The cutting edge 9 preferably is curved centrally with respect to the shearer drum axis. The cutting edge 9 projects beyond the diameter of the shearer drum body 10 in the direction of travel of the machine. The cutting edge is provided with a plurality of nozzles 11 which are mounted so as to direct a high pressure liquid jet in the direction of machine travel. Some of the nozzles 11 may be oscillating nozzles, for example, oscillating in vertical planes, oscillating in horizontal planes or in angled planes. The high pressure liquid jets 12 release a mineral strip from the face corresponding to the cross-section of the support arm. The loosened material in front of the support arm 7 or any mineral ribs 14 which might be left between the high pressure liquid jets 12 are engaged and released by the support arm cutting edge 9 and are removed together with the spoil by the inclined surface 9 toward the region of the whorls 8 of the shearer drum 6.

Figure 2:
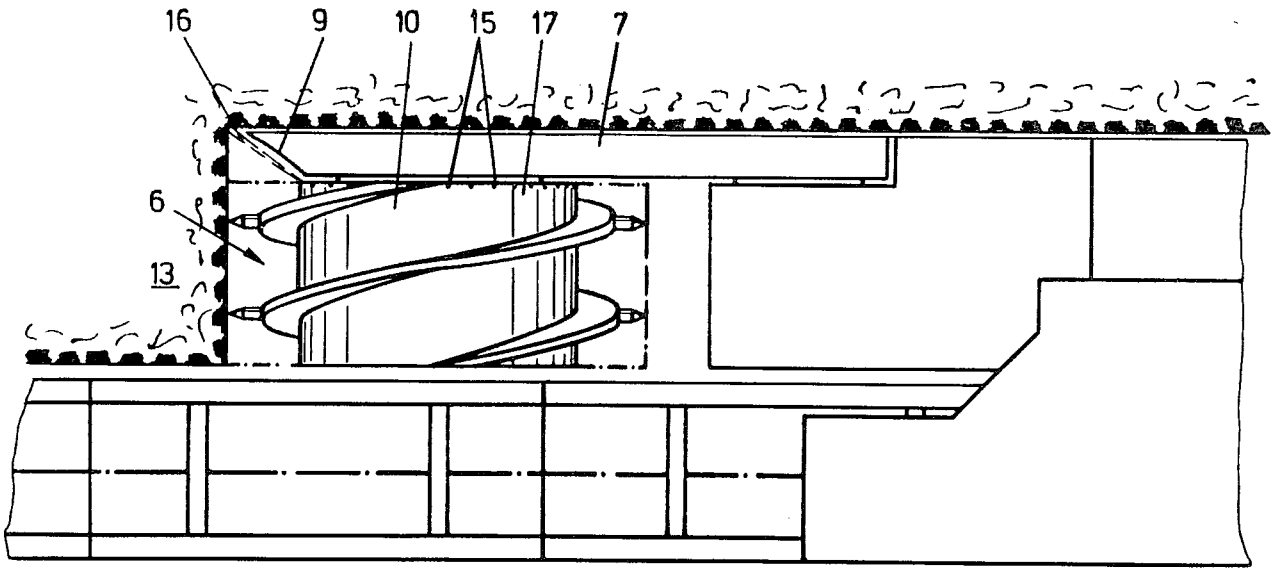
FIG. 2 is a plan view of an alternative embodiment of a drum cutter-loader and face conveyor mining apparatus.

In the embodiment of FIG. 2, the shearer drum 6 is provided with nozzles 15 which generate high pressure liquid jets 16 for cutting the support arm 7 free. The nozzles 15 are provided in the cylindrical edge zone of the shearer drum 6 adjacent to the shearer drum edge face. The nozzles 15 are so mounted that high pressure liquid jets 16 enter the face 13 parallel to the inclined surface 9 of the support arm and thereby release mineral from the face 13 in front of the arm 7 in the direction of the machine travel. The high pressure liquid feed to the individual nozzles 15 during the rotation of the shearer drum 6 is controlled so that the high pressure liquid jets 16 are presented only in those nozzles 15 when they are not opposite the support arm 7. The removal of the spoil which is loosened by the jets 16 in the deepest part of the cut occurs in the same manner already described in reference to FIG. 1.

We claim:

1. In a drum cutter-loader and face conveyor mining apparatus having an overhung shearer drum rotatable about an axis parallel to the floor, said drum being mounted on a support arm and having helical whorls for removing loosened spoil from a mining area to the said face conveyor, the improvement comprising:

support arms disposed on the face side of the said shearer drum, high pressure liquid jets for cutting the seam area to accommodate said support arm;

wherein the end of said support arm adjacent to the said shearer drum is equipped with oscillating nozzles for directing the said high pressure liquid jets substantially in the direction of travel of the said apparatus, and the said support arm is positioned forwardly of the diameter of the said shearer drum; an inclined surface extending over the entire height of said support arm forwardly of said shearer drum and functioning as a cutting edge.

2. The improvement of claim 1 wherein the said nozzles are so inclined that their high pressure liquid jets are directed in advance of the said support arm.

3. In a drum cutter-loader and face conveyor mining apparatus having an overhung shearer drum rotatable about an axis parallel to the floor, said drum being mounted on a support arm and having helical whorls for removing loosened spoil from a mining area to the said face conveyor, the improvement comprising:

support arms disposed on the face side of the said shearer drum, high pressure liquid jets for cutting the seam area to accommodate said support arm;

wherein the said shearer drum has an end face confronting the said support arm and the cylindrical edge zone of said shearer drum adjacent to the said edge face has radially outwardly directed nozzles and means for introducing high pressure liquid into those nozzles during rotation of said shearer drum which are not opposite the said inclined support arm.

4. The improvement of claim 3 wherein the said inclined surface of the said support arm is presented centrally of the axis of said drum.

* * * * *